US012740676B2

(12) United States Patent
Gibson

(10) Patent No.: US 12,740,676 B2
(45) Date of Patent: Sep. 22, 2026

(54) PORTABLE RESTROOM

(71) Applicant: Jag Mobile Solutions, Inc., Howe, IN (US)

(72) Inventor: William L. Gibson, Angola, IN (US)

(73) Assignee: Jag Mobile Solutions, Inc., Howe, IN (US)

( * ) Notice: Subject to any disclaimer, the term of this patent is extended or adjusted under 35 U.S.C. 154(b) by 121 days.

(21) Appl. No.: 18/932,715

(22) Filed: Oct. 31, 2024

(65) Prior Publication Data

US 2025/0143523 A1 May 8, 2025

Related U.S. Application Data

(60) Provisional application No. 63/595,838, filed on Nov. 3, 2023.

(51) Int. Cl.

| | |
|---|---|
| ***A47K 11/02*** | (2006.01) |
| ***E04B 1/343*** | (2006.01) |
| ***E04H 1/12*** | (2006.01) |

(52) U.S. Cl.

CPC ..... *A47K 11/02* (2013.01); *E04B 1/34336* (2013.01); *E04H 1/1216* (2013.01)

(58) Field of Classification Search

CPC ..... A47K 11/02; A47K 11/04; A47K 11/08; E04B 1/34336; E04B 1/34342; E04B 1/34363; E04H 1/1216; E04H 1/1205

USPC ..... 4/476–480

See application file for complete search history.

(56) References Cited

U.S. PATENT DOCUMENTS

| | | | | |
|---|---|---|---|---|
| 6,115,971 | A * | 9/2000 | Loebertmann | E04H 1/1216 4/449 |
| 9,464,428 | B2 * | 10/2016 | Esposito | E04B 1/35 |
| 2009/0223143 | A1 * | 9/2009 | Esposito | E04H 1/1205 52/745.19 |
| 2018/0340344 | A1 | 11/2018 | Sansom, III et al. | |
| 2020/0386006 | A1 | 12/2020 | Bikker et al. | |
| 2021/0059480 | A1 | 3/2021 | Blevins et al. | |

OTHER PUBLICATIONS

International Search Report & Written Opinion—Dated Jan. 23, 2025; PCT/US2024/054043; Filed Nov. 1, 2024.

"Sanitrax Vacuum-Flush Toilet | Modular Containerized Mobile Restroom | Events, Camps Sites, Festivals & Construction Sites," Satellite Industries, archived at https://web.archive.org/web/20230603174443/https://www.satelliteindustries.com/vacuum-technology/products/modules/toilet/, Jun. 3, 2023 (6 pages).

* cited by examiner

*Primary Examiner* — David J Walczak

(74) *Attorney, Agent, or Firm* — Barnes & Thornburg LLP

(57) ABSTRACT

A portable restroom with a base spaced apart from a ceiling. There are a plurality of walls therebetween that together define an interior of the restroom with one or more toilets. The restroom has at least one door configured to provide ingress into the interior. A plurality of fork tine ports are provided over the door that receive forklift tines for moving the portable restroom by its ceiling.

10 Claims, 11 Drawing Sheets

PORTABLE RESTROOM

RELATED APPLICATIONS

This application claims the benefit of U.S. Provisional Application Ser. No. 63/595,838 filed Nov. 3, 2023 for a "Portable Restroom," which is hereby incorporated by reference in its entirety.

TECHNICAL FIELD

The present disclosure generally relates to portable restrooms; more particularly, portable restrooms that are compliant with certain accessibility laws and regulations, such as the Americans with Disabilities Act.

BACKGROUND

There are accessibility requirements dictated by certain laws and regulations within Europe, the United States, and elsewhere. In the United States, the Americans with Disabilities Act ("ADA") was enacted in 1990. The ADA is a civil rights law that prohibits discrimination against individuals with disabilities in all areas of public life, including jobs, schools, transportation, and all public and private places that are open to the general public. One purpose of the law is to make sure that people with disabilities have the same rights and opportunities as everyone else.

The ADA places restrictions on entryways into structures to allow individuals, such as those in wheelchairs, who require ramps or low elevations changes ingress and egress. In particular, there are restrictions on changes in level between flooring of different structures and the ground. Currently, changes in level can be up to one quarter inch (¼") without treatment or one half inch (½") if beveled with a slope no steeper than 1:2. Changes in level above a half inch (½") must be treated as a ramp or curb ramp (or a walkway if a slope no steeper than 1:20 can be achieved). These specifications apply to all portions of accessible routes, including thresholds and carpet trim.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION

Figure 1:
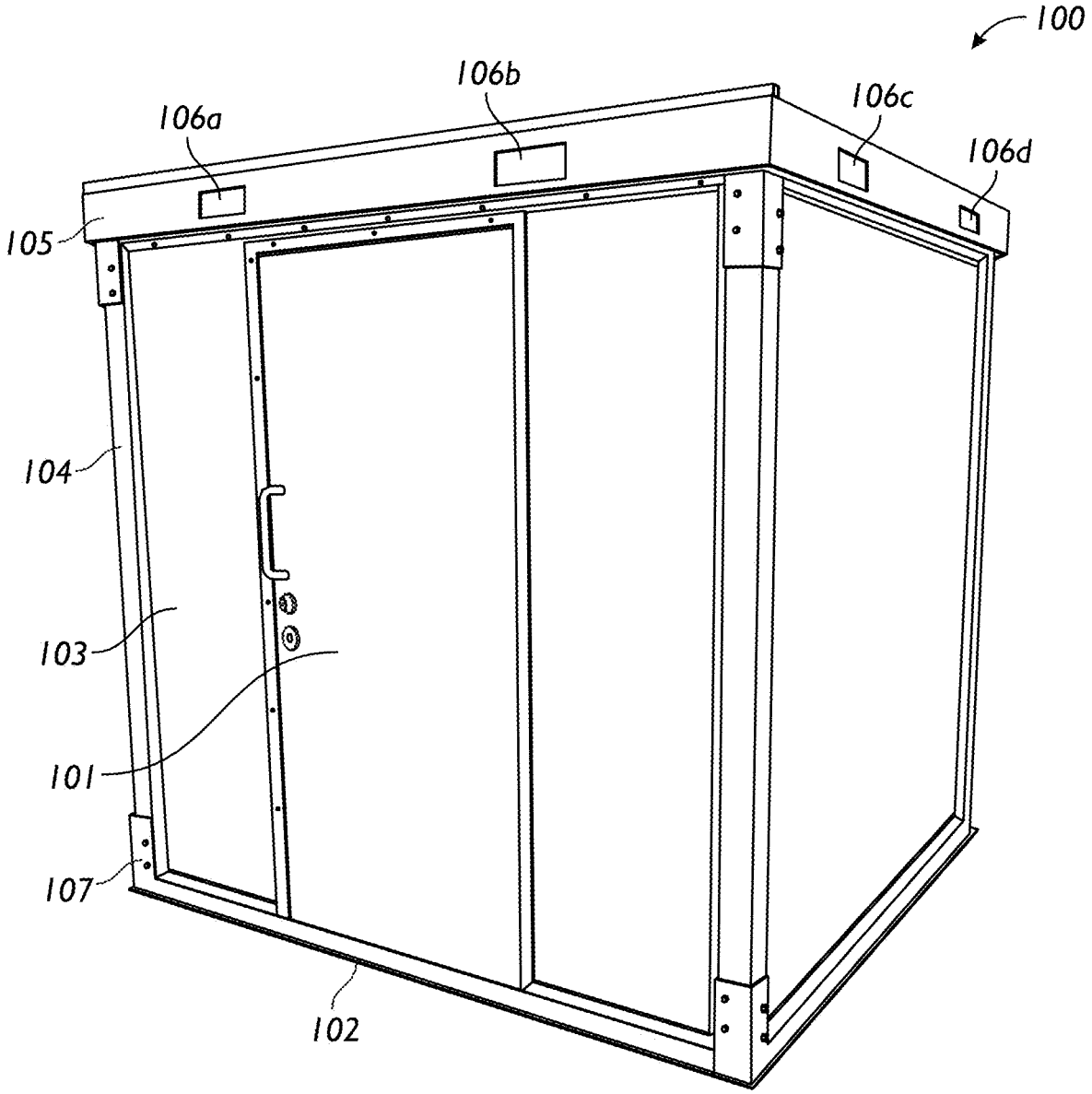
FIG. 1 is a front perspective view of an example portable restroom according to an embodiment of this disclosure.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

In the drawings, some structural features may be shown in specific arrangements. However, it should be appreciated that such specific arrangements may not be required. Rather, in some embodiments, such features may be arranged in a different manner than shown in the illustrative figures. Additionally, the inclusion of a structural in a particular figure is not meant to imply that such feature is required in all embodiments and, in some embodiments, may not be included or may be combined with other features.

In some embodiments, the present disclosure is directed towards a portable restroom configured to meet one or more accessibility requirements. Instead of having fork tine ports on the base of the portable restroom, which would require a ramp to comply with the ADA, in some embodiments, this disclosure provides a technical advantage of having fork tine ports overhead, thereby eliminating the ramp requirement. For example, with the fork tine ports overhead, there may be a less than one quarter inch rise between the exterior ground level and the interior floor of the portable restroom. This rise is compliant with the accessibility restrictions of the ADA, and therefore, no ramp is required.

Additionally, in some embodiments, this disclosure provides a portable restroom that can be connected in series with other portable restrooms such that a single vacuum system and wastewater tank can be used among multiple portable restrooms. This eliminates the need for multiple redundant vacuum systems located in each portable restroom, and increases ease of serviceability and ease of use. Furthermore, in some embodiments, the portable restroom includes a steel frame with inset wall panels. This allows the portable restroom to be moved and positioned without damaging the walls.

Referring to FIG. 1, there is shown an embodiment of a portable restroom 100. The portable restroom 100 has a door 101 and a plurality of wall panels 103. As shown, the portable restroom 100 includes a base 102. The base 102, in some embodiments, rests on an exterior surface, such as the ground. In some embodiments, the thickness of the base 102 is dimensioned so the elevation change between the base 102 and the exterior surface, such as the ground, is less than one quarter inch (¼"). Therefore, the base 102 is operatively sized such that it complies with the requirements of the ADA. Depending on the circumstances, the thickness of the base 102 could vary depending on the applicable accessibility laws or regulations.

In the embodiment shown, the base 102 includes a plurality of vertical support mounts 107 which may be connected with a plurality of vertical supports 104 to be connected to a ceiling 105 forming a rigid structure. In some cases, the wall panels 103 may be connected to the base 102 and the ceiling 105 via the plurality of vertical supports 104. As shown, the wall panels 103 are spaced between the vertical supports 104. Depending on the circumstances, the wall panels 103 may be constructed from any number of suitable materials including but not limited to fiberglass, polymer, or sheet metal. In the embodiment shown, the wall panels 103 are inwardly offset from the exterior surface of the vertical supports 104 to protect the wall panels 103. For example, in some cases, the offset could be at least one half inch (½") such that the wall panels 103 will not make contact with adjacent structures or other portable restrooms 100 during transport and deployment of the portable restroom 100. This arrangement, in some cases, prevents the need for the wall panels 103 to be strengthened, which reduces the weight of the portable restroom 100. Additionally, in some cases, this prevents the need for frequent replacement of the wall panels 103 due to damage to the wall panels 103.

In the embodiment shown, the ceiling 105 has a plurality of ports 106*a-d* for fork lift tines to enter and transport the portable restroom 100. As shown, two fork tine ports 106*a-b* are located above the door 101 on a first side of the portable restroom 100 and extend through the entire ceiling 105. In the example shown, a second set of two fork tine ports 106*c-d* are located on a second side of the portable restroom 100 and also extend through the entire ceiling 105. With this arrangement, a fork lift can insert its fork lift tines into either set of fork tine ports 106*a-d* to move the portable restroom 100.

Figure 2:
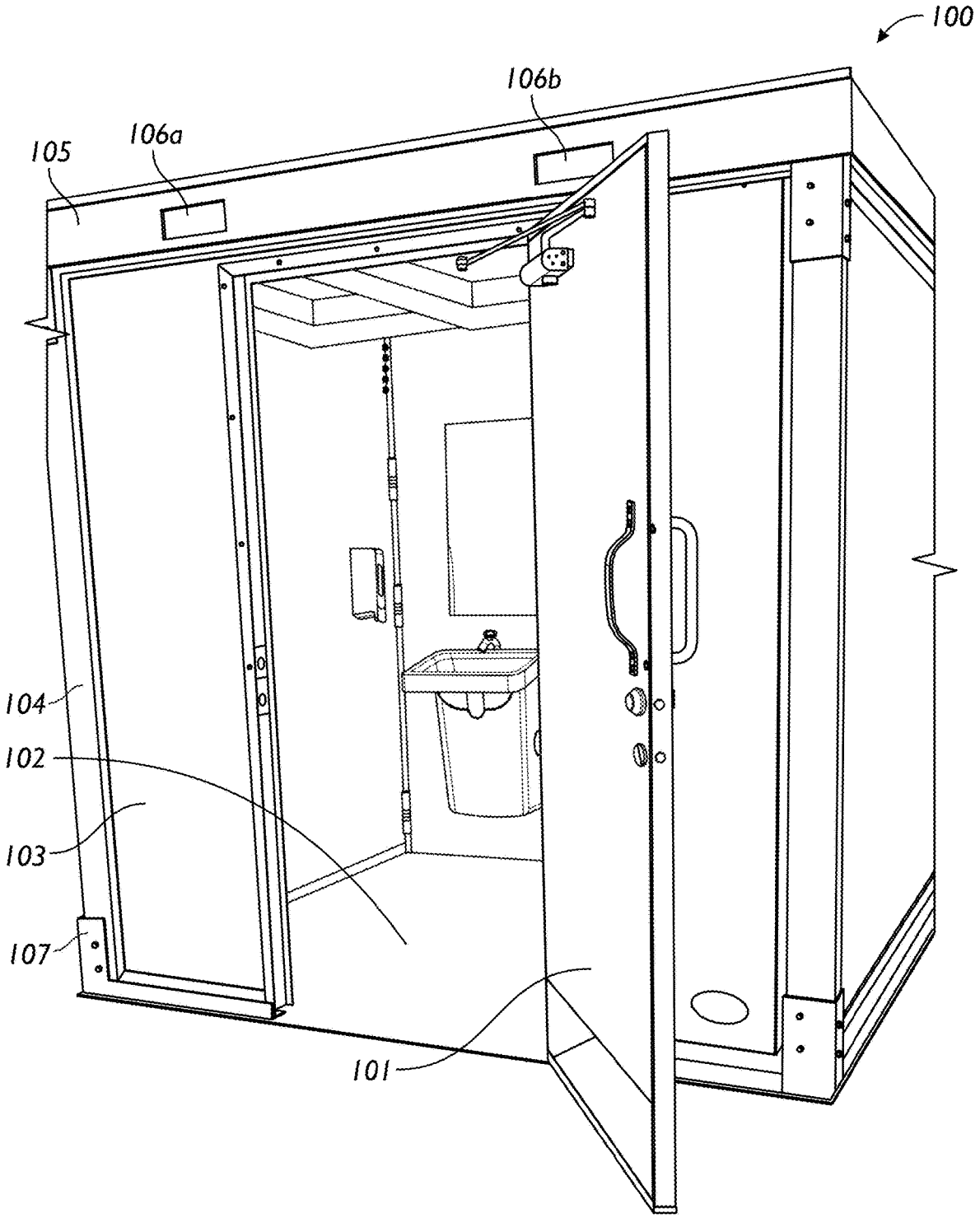
FIG. 2 is a detailed, front perspective view of the example portable restroom of FIG. 1 with the door open to reveal an interior space.

Referring now also to FIG. 2, the portable restroom 100 is shown with the door 101 in the open position such that ingress into the portable restroom 100 is permitted. As shown, the thickness of the base 102 of the portable restroom 100 is operatively sized such that is meets ADA compliance for elevation changes. For example, in some cases, the base 102 could be formed from a sheet with a thickness dimensioned to satisfy the elevation change requirements of the ADA. By way of example only, the base 102 could be a metal sheet, composite sheet, or other type of sheet. Since the base 102 typically rests on the ground, in some cases, the base 102 could be formed from a weather or rust-resistant sheet or be coated with a weather or rust-resistant coating. As shown, the base 102 forms the interior floor of the portable restroom 100.

Figure 3:
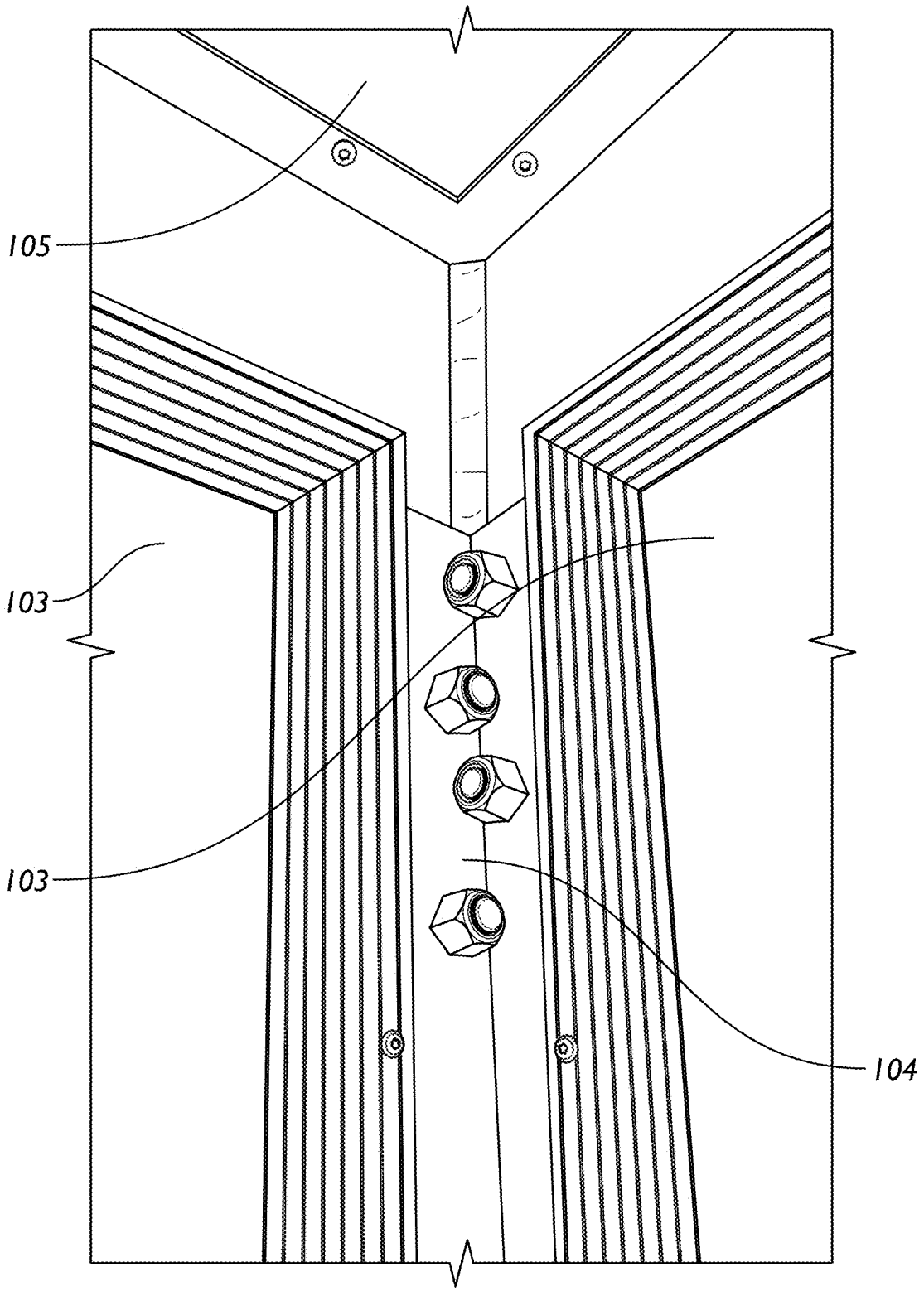
FIG. 3 is a detailed perspective view of an example vertical joint in the interior of the example portable restroom of FIG. 2.

FIG. 3 illustrates a detailed view of the wall panels 103 connections to the vertical supports 104 and the ceiling 105 according to an embodiment of this disclosure. As shown, each corner of the portable restroom has two wall panels 103 secured to the ceiling 105 and the vertical supports 104 to provide structural rigidity and the ability for the portable restroom 100 to be lifted from the ceiling 105. In some embodiments, the wall panels 103 could be offset from the exterior surface of the vertical supports 104 such that they do not contact adjacent structures when the portable restroom 100 is deployed in close-quarter locations.

Figure 4A:
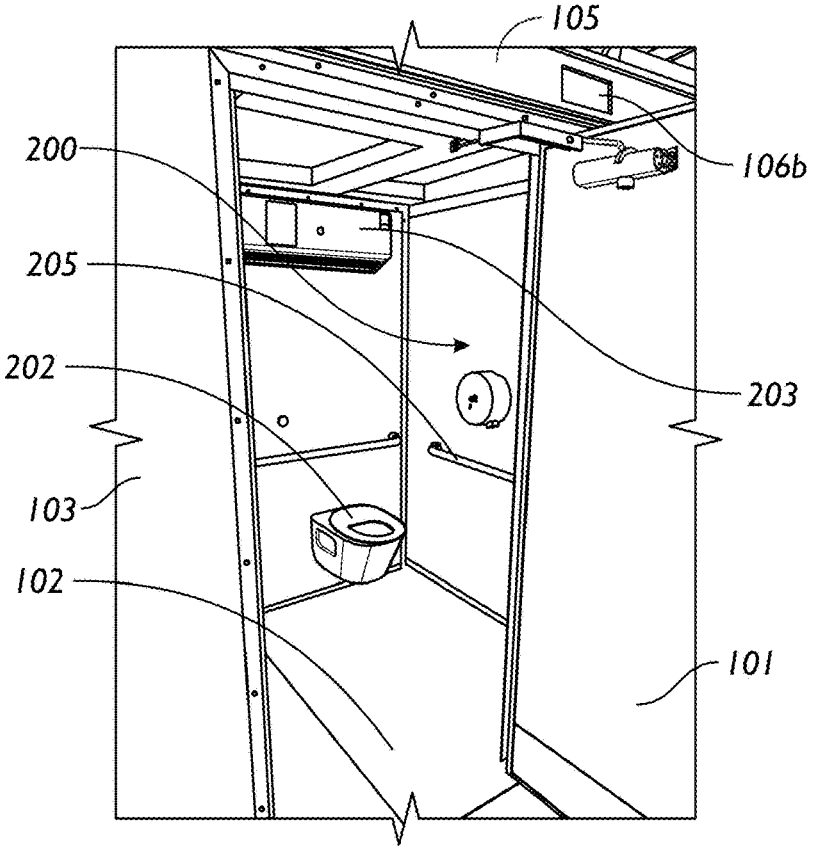
FIG. 4A is a detailed perspective view of the example portable restroom of FIG. 2.
Figure 4B:
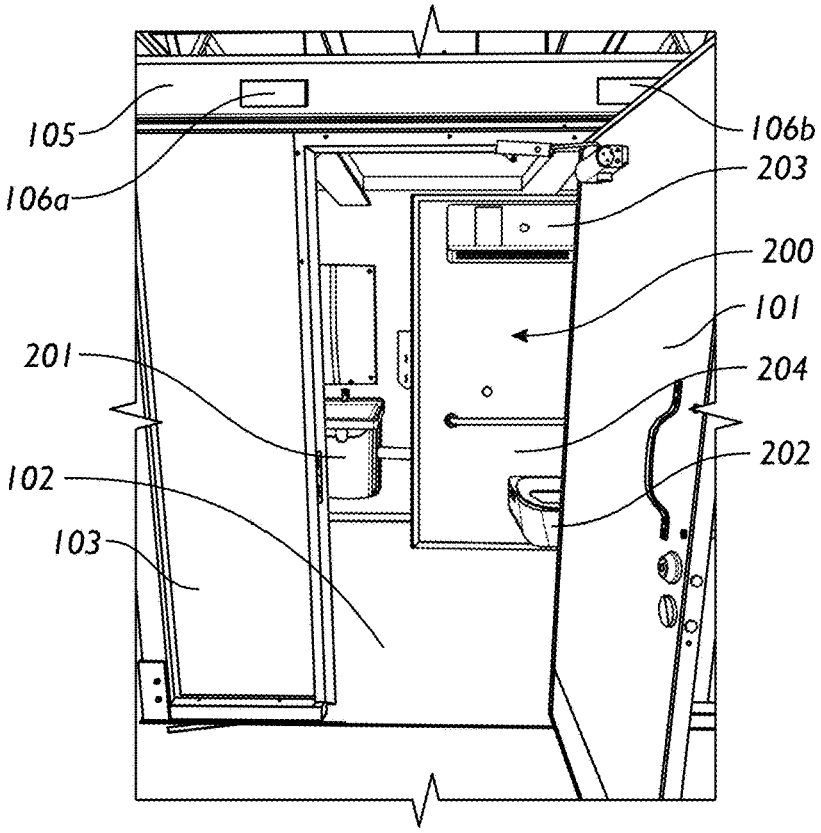
FIG. 4B is a detailed perspective view of the interior of example the portable restroom of FIG. 2.

FIGS. 4A and 4B show an example portable restroom interior 200. In the embodiment shown, the portable restroom interior 200 is defined by the wall panels 103, base 102, door 101, and ceiling 105. Within the portable restroom interior 200, a number of different fixtures may be installed depending on the circumstances. In the embodiment shown, a sink 201 and a toilet 202 are installed on a wall panel 103. In other or the same embodiments, HVAC system 203 may be installed. In other embodiments, a shower (not shown) or other fixture may be installed.

As shown, behind the toilet 202 and HVAC system 103, there is a utilities annex 204. The utilities annex 204 may comprise any number of support systems (not shown) to provide utilities to the portable restroom 100. Depending on the circumstances, handrails 205 may also be installed on the wall panels 103 in compliance with the requirements of the ADA. Any number of additional components may be installed in the portable restroom interior 200 such as lights, a mirror, sanitary napkin dispensers, paper towel dispensers, soap dispensers, hooks, shelves, and/or similar components. Additionally, in some embodiments, a vent fan (not shown) may be installed to exhaust waste air from the portable restroom interior 200 to the exterior.

Figure 5:
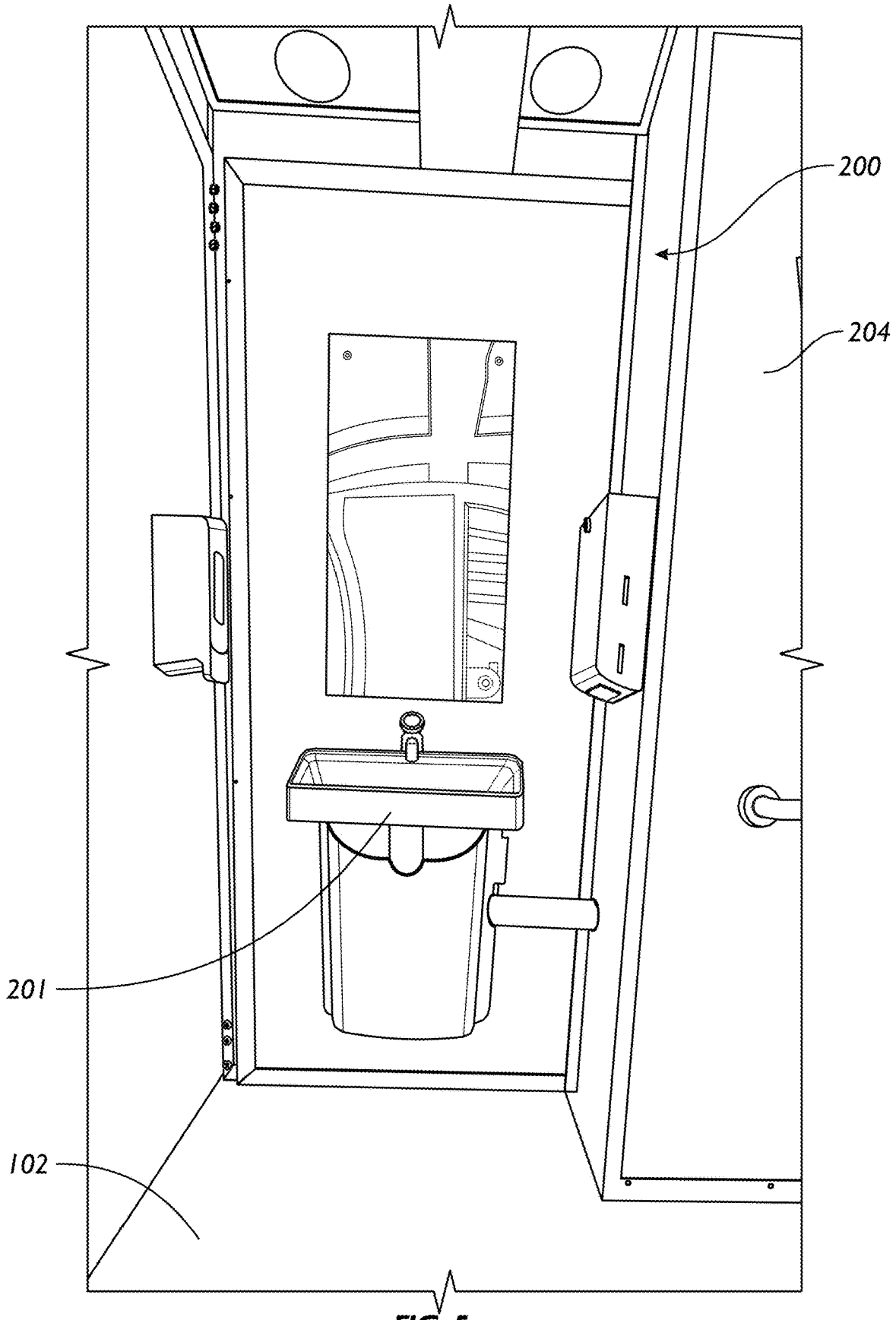
FIG. 5 is a detail view of the interior of the example portable restroom of FIG. 2.

Turning next to FIG. 5, a detail view of the example portable restroom interior 200 is shown. In the embodiment shown, the utilities annex 204 may be located on the right side of the sink 201. In other embodiments, the utilities annex may be located in any of the wall panels 103. A person having ordinary skill in the art would recognize that the utilities annex 204 may be located in any location such that access to the utilities is restricted for users of the portable restroom 100 while access for maintenance personnel is simplified.

Figure 6:
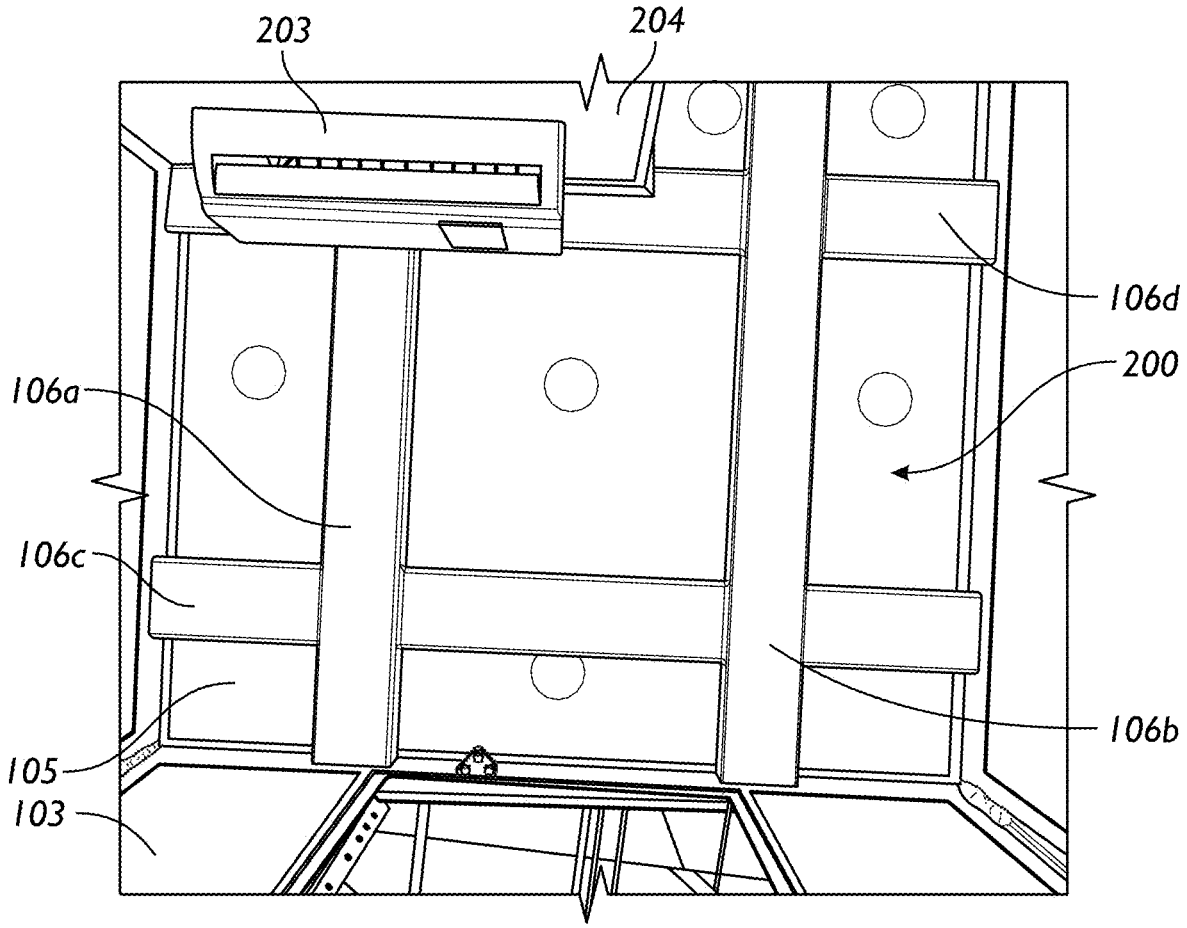
FIG. 6 is a perspective view showing an example ceiling configuration of the interior of the example portable restroom of FIG. 2.

FIG. 6 illustrates a detail view of the example ceiling 105 in the portable restroom interior 200. The utilities annex 204 is shown with the HVAC system 203 mounted on the utilities annex 204. In other embodiments, the HVAC system 203 may be mounted on any wall panel 103. In some embodiments, this allows for exhaust air from the HVAC system 103 to be exhausted outside of the portable restroom 100. The wall panels 103 are shown in this embodiment connected to the ceiling 105. As shown, the ceiling 105 includes the fork tine ports 106*a-d*. The fork tine ports 106*a-d* extend through the ceiling 105 from a first end to a second end such that a fork lift could insert its tines into any side of the portable restroom 100 in order to deploy and position the portable restroom 100.

Figure 7:
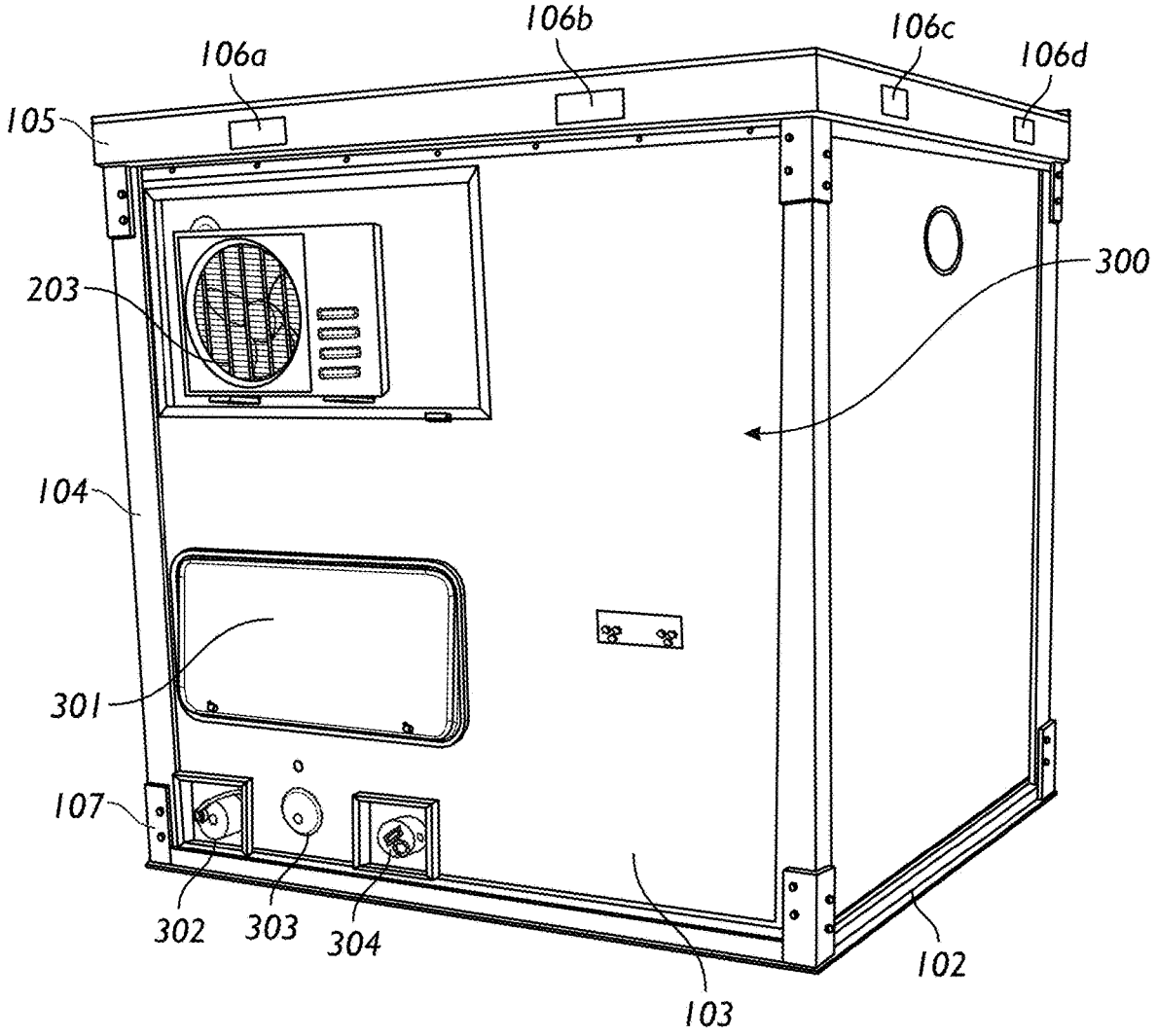
FIG. 7 is a rear perspective view of the example portable restroom of FIG. 1.

Turning next to FIG. 7, in the embodiment shown, the portable restroom 100 includes a rear panel 300. As shown, the wall panels 103 connected to the ceiling 105. The ceiling 105 includes the fork tine ports 106*a-d*. The fork tine ports 106*a-d* extend through the ceiling 105 from a first end to a second end such that a fork lift could insert its tines into any side of the portable restroom 100. Additionally, the exterior side of the HVAC system 203 is shown. In the embodiment shown, the vertical supports 104 are mounted to the base 102, which support the wall panels 103, and further support a number of ports for various utilities. In some embodiments, these ports comprise an access panel 301 for access to the utility connections within the utilities annex 204. Additionally, there is a vacuum inlet 302 and a vacuum outlet 304 on the rear panel 300 of the portable restroom 100. The vacuum inlet 302 is configured to be connected to an external vacuum system (not shown) such that the portable restroom 100 receives external vacuum in order to facilitate the removal of waste from the toilet 202 and sink 201. For example, the portable restroom 100 could be connected to a vacuum system such the Jets Vacuum System offered by Jets Vacuum AS of Hareid, Norway. In the embodiment shown, the rear panel 300 further has a power connection 303 to provide electricity to the portable restroom for at least the lighting. The vacuum outlet 304, in some embodiments, can be connected to a second portable restroom 100. If the vacuum outlet 304 is not connected to a separate portable restroom 100, it would typically be plugged during operation of the portable restroom 100.

Figure 8:
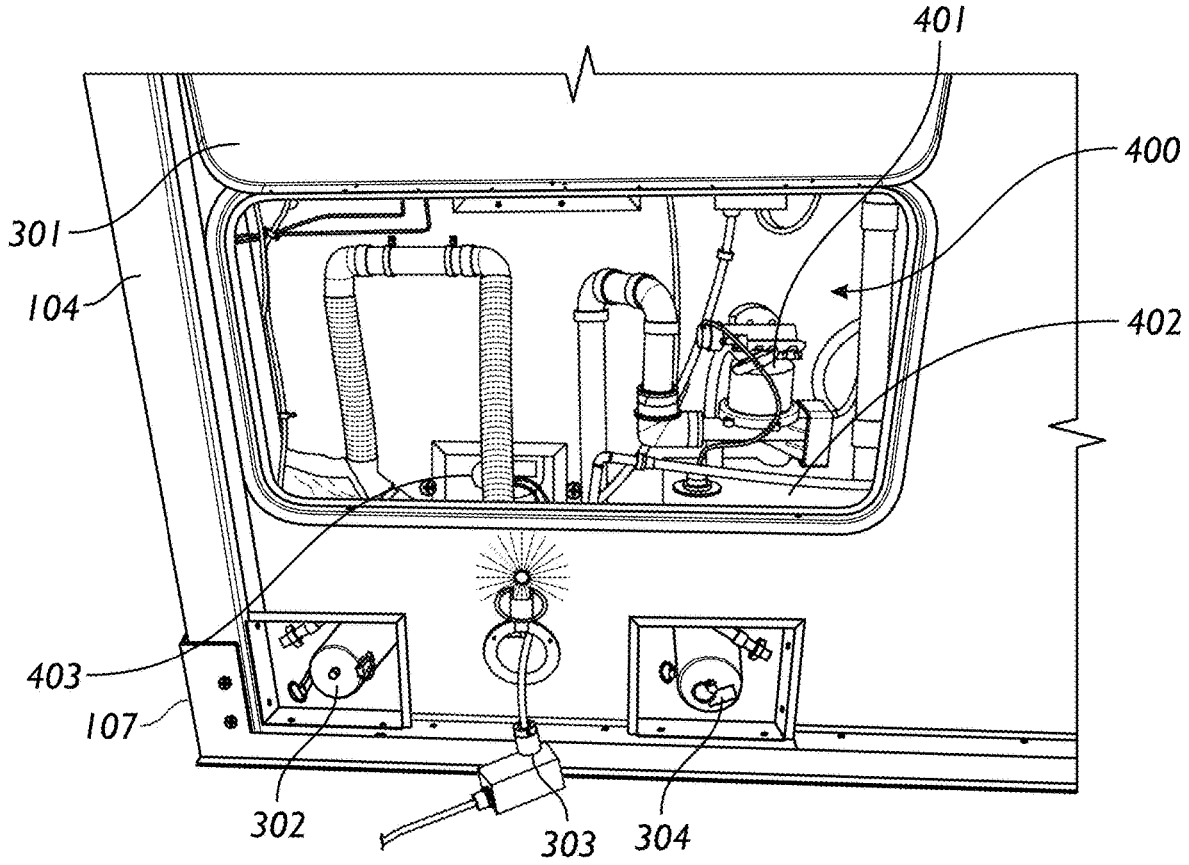
FIG. 8 is a detailed rear view of the portable restroom of FIG. 1 with an access panel opened to show internal components.

FIG. 8 shows a detail view of the rear panel 300 of the portable restroom 100 according to an embodiment of this disclosure. In some embodiments, the rear panel 300 and access panel 301 are operatively constructed from fiberglass. In other or the same embodiments, the rear panel 300 and access panel 301 may be constructed from polymer or sheet steel or other materials. As shown, the access panel 301 lifts up to reveal the utilities annex interior 400. In the embodiment shown, the utilities annex interior 400 provides access to the utilities that support the functionality of the portable restroom 100. For example, the utilities may comprise a water pump 401 and water tank 402. In some embodiments, the water pump 401 pressurizes the water stored within the water tank 402 and pumps it to the sink 201 and toilet 202. Depending on the circumstances, the utilities also may comprise a vacuum toilet actuator 403 to actuate the toilet 202 when an external vacuum is connected to the vacuum inlet 302. In some cases, the access panel 301 may be sealed against the rear panel 300 to prevent water ingress into the utilities annex interior 400 which could damage the electrical wiring contained therein.

Figure 9:
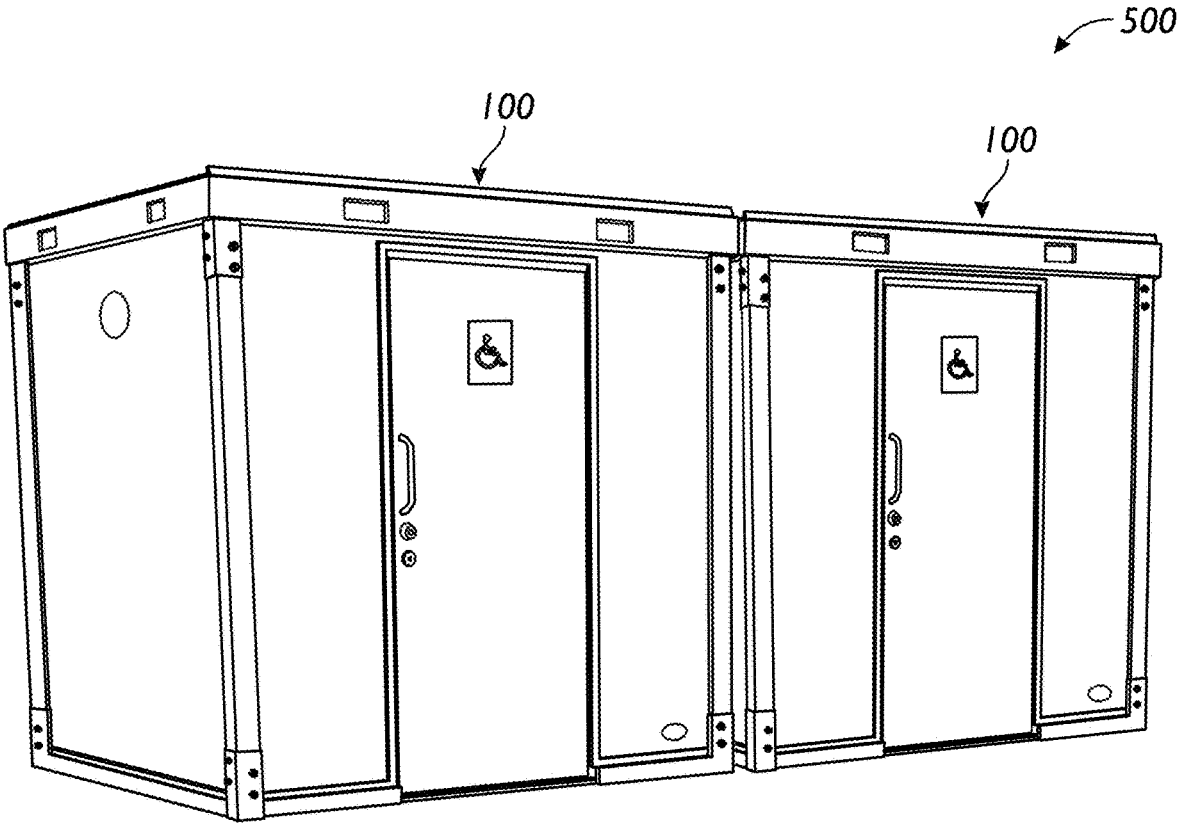
FIG. 9 is a front perspective view of a plurality of portable restrooms.
Figure 10:
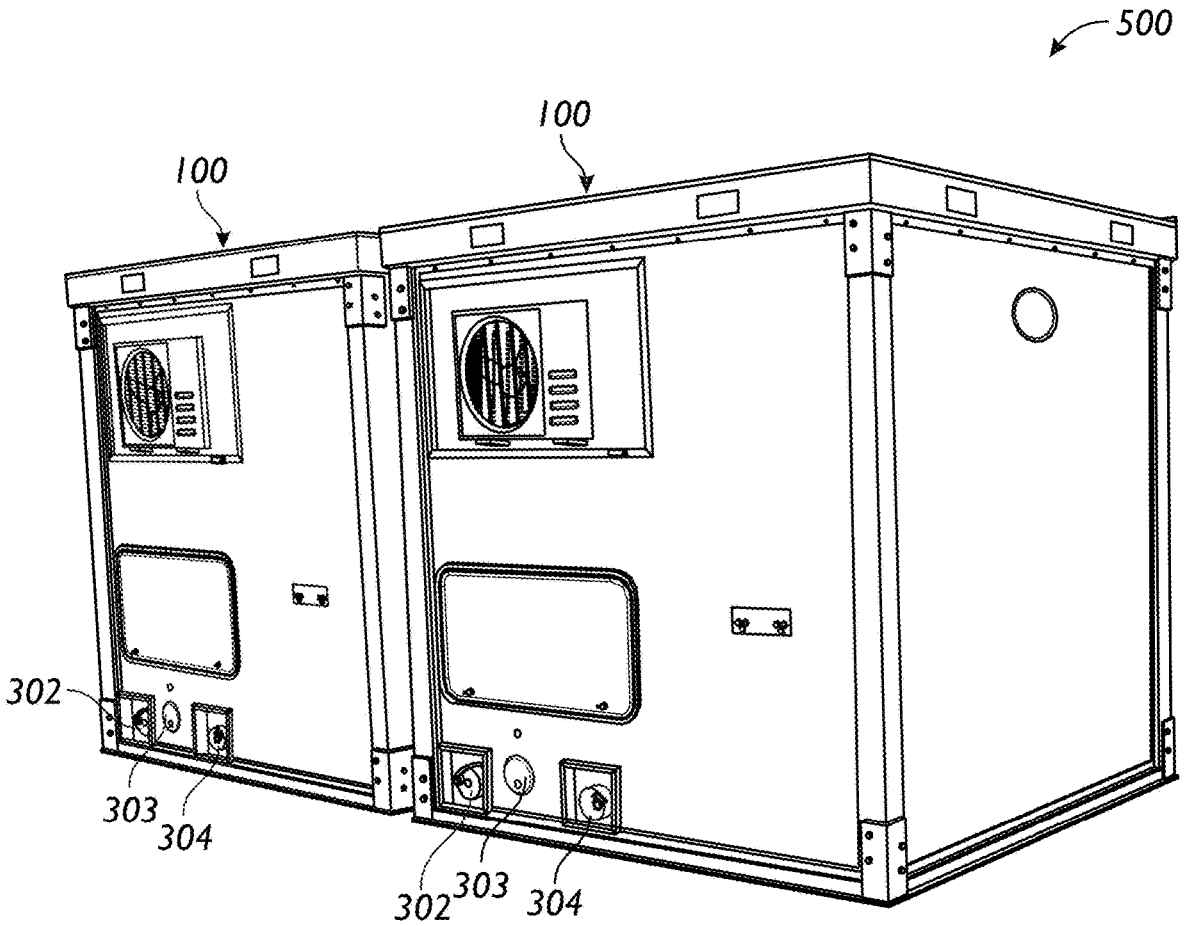
FIG. 10 is a rear perspective view of the plurality of portable restrooms of FIG. 9 prior to being fluidly connected together.

In some embodiments, shown by example in FIGS. 9 and 10, a plurality of portable restrooms 500 could be fluidly connected. For example, the plurality of portable restrooms 500 may be formed from any number of interconnected portable restrooms 100. In some embodiments, the plurality of portable restrooms may be configured to run off a single external vacuum system (not shown) such that a separate vacuum system and wastewater tank is not required for each portable restroom 100. FIG. 10 shows the plurality of portable restrooms 500 from the rear. The vacuum inlets 302, power connections 303, and vacuum outlets 304 are all shown.

Figure 11:
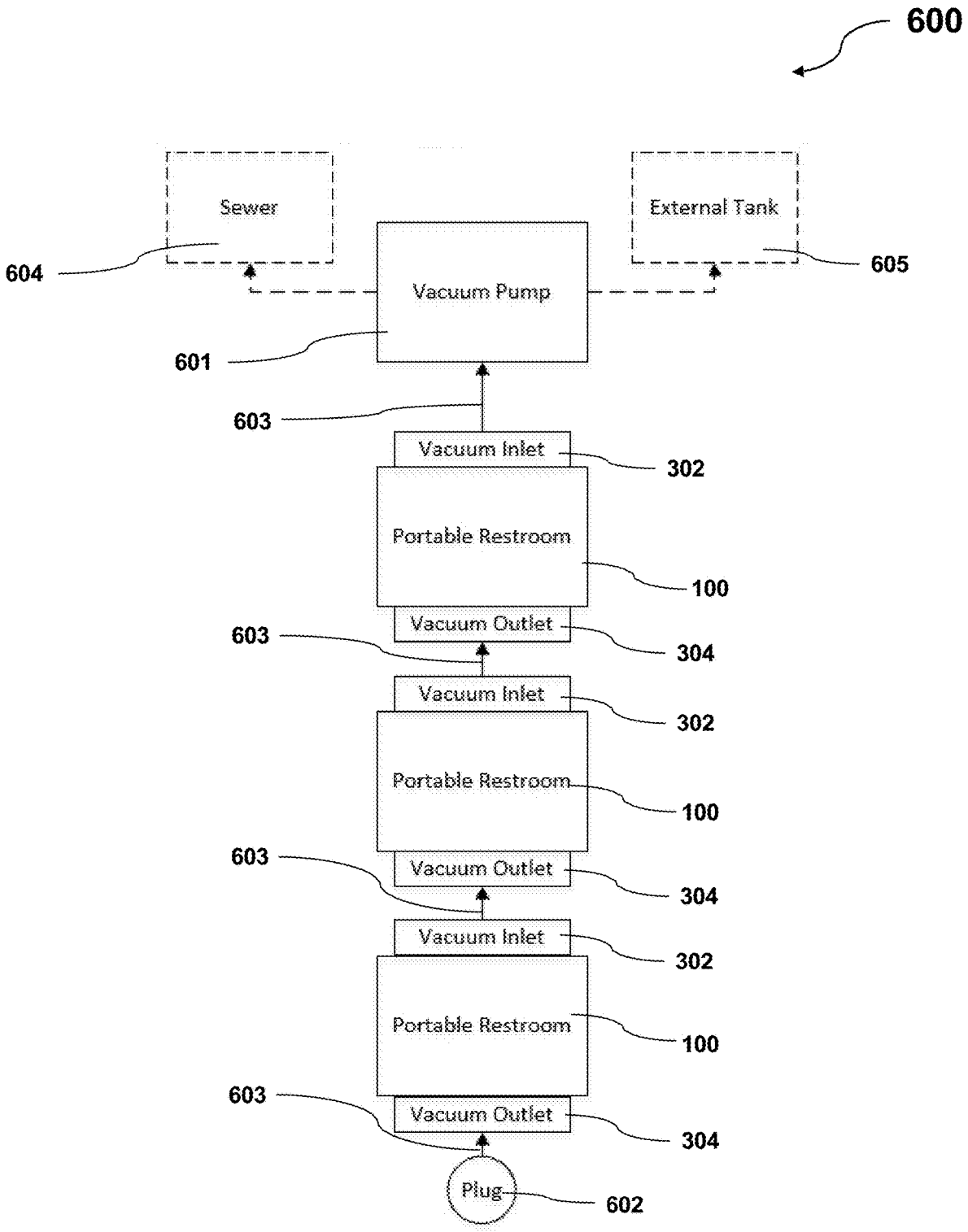
FIG. 11 is a diagrammatic view in which a plurality of the example portable restrooms of FIG. 9 are fluidly connected with a vacuum system.

Turning next to FIG. 11, there is shown a diagrammatic view of fluidly connecting a plurality of portable restrooms 600 according to an embodiment on this disclosure. In some embodiments, the portable restrooms 600 may be in fluid connection with a vacuum pump 601 to draw out waste from the portable restrooms 600. The vacuum pump 601, in some embodiments, may be connected to either a local or municipal sewer 604, or alternatively, an external tank 605. Depending on the location of the plurality of portable restrooms 500, it may be advantageous to use an external tank 605, such as in rural areas which do not have access to municipal sewers 604. In some cases, a single vacuum pump 601 may be used across any number of portable restrooms 100. Using vacuum hoses 603, the vacuum pump 601 is connected to the vacuum inlet 302 of the first portable restroom 100. The vacuum outlet 304 of the first portable restroom 100 is connected to the vacuum inlet 302 of a second portable restroom 100. The vacuum outlet 304 of the second portable restroom 100 is connected to the vacuum inlet 302 of the third portable restroom 100. The vacuum outlet 304 of the third portable restroom 100 is plugged with a plug 602. This allows a vacuum pump 601 to supply vacuum and access to either a sewer 604 or external tank 605 for disposal of wastewater to any number of portable toilets.

It is to be understood that the invention is not limited to the exact details of construction, operation, exact materials or embodiments shown and described, as obvious modifications and equivalents will be apparent to one skilled in the art. While the specific embodiments have been illustrated and described, numerous modifications come to mind without significantly departing from the spirit of the invention, and the scope of protection is only limited by the scope of the accompanying Claims.

The invention claimed is:

1. A portable restroom comprising:

a base spaced apart from a ceiling by a plurality of walls to define an interior with one or more toilets, wherein the base is formed from a sheet having a thickness dimensioned to comply with one or more elevation change requirements of the Americans with Disabilities Act (ADA);

at least one door configured to provide ingress into the interior;

a plurality of fork tine ports configured to receive tines of a forklift for moving the portable restroom; and wherein the plurality of fork tine ports are positioned above the at least one door.

2. The portable restroom of claim 1, wherein the sheet comprises a metal sheet and/or a composite sheet.

3. The portable restroom of claim 1, wherein the sheet has a thickness of 0.25 inches or less.

4. The portable restroom of claim 1, wherein the sheet has a thickness of 0.5 inches or less with a beveled edge.

5. The portable restroom of claim 1, wherein the sheet forms a floor of the interior.

6. The portable restroom of claim 1, further comprising a plurality of vertical supports extending between the base and the ceiling.

7. The portable restroom of claim 6, wherein at least a portion of the plurality of walls define one or more vertical edges and wherein the vertical supports are positioned at least at a portion of the one or more vertical edges of the portable restroom.

8. The portable restroom of claim 6, wherein the vertical supports are operatively connected to the ceiling to provide structural support for the portable restroom to be lifted by the ceiling.

9. A portable restroom comprising:

a base spaced apart from a ceiling by a plurality of walls to define an interior with one or more toilets, wherein the base is formed from a sheet having a thickness dimensioned to comply with one or more elevation change requirements of the Americans with Disabilities Act (ADA);

at least one door configured to provide ingress into the interior;

a plurality of fork tine ports configured to receive tines of a forklift for moving the portable restroom; and wherein at least a portion of the plurality of fork tine ports are positioned above the at least one door.

10. A portable restroom comprising:

a restroom structure defining an interior with one or more toilets, wherein the restroom structure includes a base formed from a sheet having a thickness dimensioned to comply with one or more elevation change requirements of the Americans with Disabilities Act (ADA);

at least one door configured to provide ingress into the interior;

a plurality of fork tine ports configured to receive tines of a forklift for moving the portable restroom; and wherein at least a portion of the plurality of fork tine ports are positioned above the at least one door.

* * * * *